US005950449A

United States Patent [19]

Park et al.

[11] Patent Number: 5,950,449

[45] Date of Patent: Sep. 14, 1999

[54] REFRIGERATOR HAVING COOL AIR DISPERSING BLADES OF WHICH ANGULAR POSITION IS CHANGED SUCCESSIVELY

[75] Inventors: Hae Jin Park, Suwon; Jae In Kim, Seoul, both of Rep. of Korea

[73] Assignee: SamSung Electronics Co., Ltd., Suwon-City, Rep. of Korea

[21] Appl. No.: 09/121,115

[22] Filed: Jul. 23, 1998

[30] Foreign Application Priority Data

Jul. 24, 1997 [KR] Rep. of Korea ..... 1997-34634

[51] Int. Cl.[6] ..... F25D 17/06; F25D 17/04

[52] U.S. Cl. ..... 62/408; 62/407; 62/186

[58] Field of Search ..... 62/407, 408, 186

[56] References Cited

U.S. PATENT DOCUMENTS 5,737,935 4/1998 Heo ..... 62/186
5,775,124 7/1998 Park et al. ..... 62/408
5,778,688 7/1998 Park et al. ..... 62/89
5,809,799 9/1998 Jeon ..... 62/408

FOREIGN PATENT DOCUMENTS 404177074 6/1992 Japan ..... 62/408

*Primary Examiner*—Henry Bennett
*Assistant Examiner*—Melvin Jones
*Attorney, Agent, or Firm*—Burns, Doane, Swecker & Mathis, L.L.P.

[57] ABSTRACT

Disclosed is a refrigerator having cool air dispersing blades. The blades are rotatably disposed near cool air discharge ports in a duct. The discharge direction of the cool air is determined by angular positions of the blades. The blades are driven by a motor capable of controlling an angular position thereof. A microprocessor controls the motor so that the angular position of the blades is successively changed with a predetermined time interval. Then the temperature of the compartment is maintained uniform effectively.

8 Claims, 13 Drawing Sheets

REFRIGERATOR HAVING COOL AIR DISPERSING BLADES OF WHICH ANGULAR POSITION IS CHANGED SUCCESSIVELY

BACKGROUND OF THE INVENTION

1. Field of the Invention

The present invention relates to a refrigerator having a device for dispersing cool air into a cooling compartment uniformly, and more particularly, to a refrigerator having cool air dispersing blades capable of supplying cool air to a plurality of areas in a cooling compartment successively.

2. Prior Art

In general, a refrigerator has a cabinet for forming a pair of cooling compartments, i. e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has solved such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 is comprised of a rotational shaft 131 having a vertical axis, cool air dispersing blades 132 assembled with the rotational shaft 131 in correspondence with the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 131 rotates the rotational shaft 131 at a low speed, the cool air flowing along the supply duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, left or right side of the fresh food compartment 3 may not be supplied with the cool air sufficiently according to the rotational direction of the rotational shaft 131, and the smooth flow of cool air may be impeded by a vortex of the cool air formed about the cool air discharge ports 16.

Moreover, in such a conventional cool air dispersing device 130, since the cool air dispersing blades 132 are simply rotated, the uniform cooling cannot be achieved effectively.

SUMMARY OF THE INVENTION

The present invention has been proposed to overcome the above- described problems in the prior art, and accordingly it is the object of the present invention to provide a refrigerator having a cool air dispersing device capable of preventing vortex of cool air and distributing the cool air effectively.

To achieve the above object, the present invention provides a refrigerator having a cooling compartment for storing food, and a duct being provided in a side wall of said cooling compartment, said duct for forming a cool air passage, said duct having at least one cool air discharge port opened into said cooling compartment, said refrigerator comprising: a horizontal-dispersing blade of planar plate shape being rotatably installed near the cool air discharge port in said duct, said horizontal-dispersing blade for controlling a discharge direction of cool air discharged through the discharge port horizontally according to an angular position thereof; a rotational shaft being connected with said horizontal-dispersing blade, said rotational shaft being extended along a vertical axis; a motor for rotating said rotational shaft, said motor being capable of controlling an angular position thereof; and a control part for controlling said driving motor so that said horizontal-dispersing blade is stopped at a plurality of angular positions successively during predetermined times respectively.

Said control part controls said driving motor so that respective predetermined times that said horizontal-dispersing blade is stopped at said plurality of angular positions are the same with each other.

Preferably, a plurality of temperature sensors for sensing temperatures of a plurality of areas in said cooling compartment respectively are installed in said cooling compartment, and said control part controls said driving motor so that a time that said horizontal-dispersing blade is stopped at an angular position corresponding to an area of high temperature among said plurality areas is longer than a time that said horizontal-dispersing blade is stopped at other angular positions. Then, a greater amount of cool air is supplied to the high temperature area.

The refrigerator according to the present invention further comprises: a plurality of vertical-dispersing blades having a horizontal rotational axis; and a means for pivoting said vertical-dispersing blades vertically.

Here, said pivoting means comprises: a link member having a plurality of hinge assembly parts respectively assembled with said vertical-dispersing blades at positions distanced from said horizontal axis, said link member being capable of moving up and down in the vertical direction; and a means for elevating/de-elevating said link member.

Said driving motor is a stepping motor.

According to the present invention, the cool air is supplied without a vortex, and is dispersed effectively since the angular position of the cool air dispersing blades is successively changed with predetermined time intervals. In particular, the cool air is more uniformly distributed since the time that the cool air dispersing blades are stopped toward the high temperature area is longer than the time toward the other areas.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
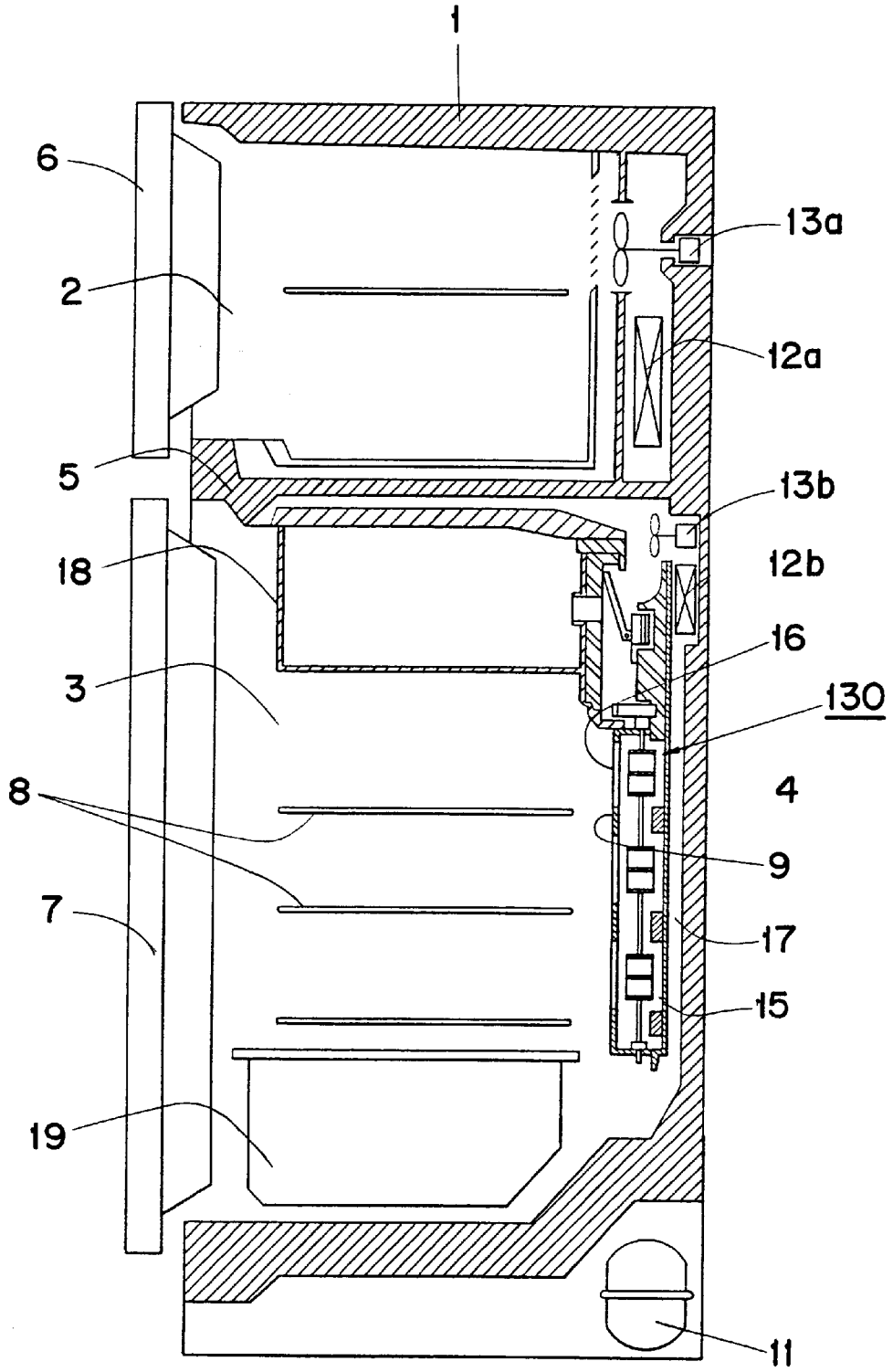
FIG. 1 (PRIOR ART)
FIG. 1 is a side sectional view of a conventional refrigerator having cool air dispersing blades.
Figure 2:
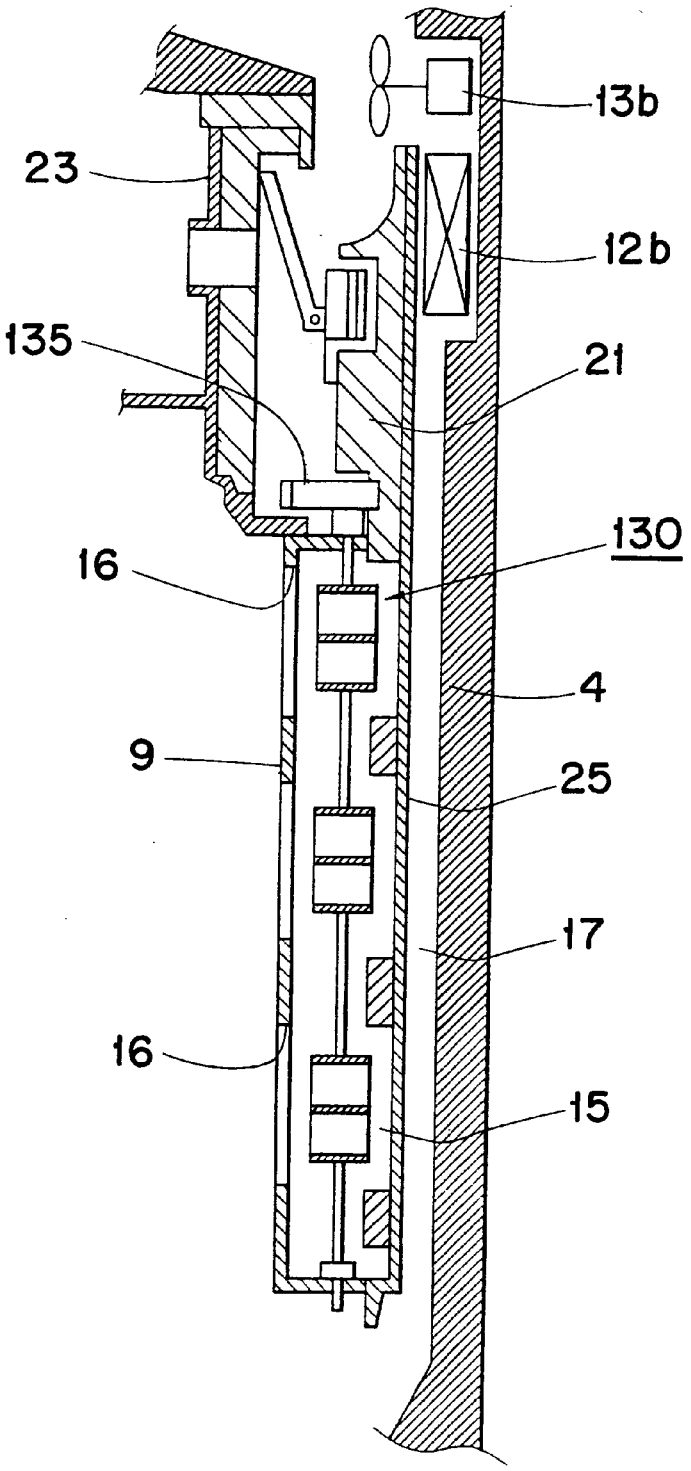
FIG. 2 (PRIOR ART)
FIG. 2 is a partial enlarged sectional view of FIG. 1.
Figure 3:
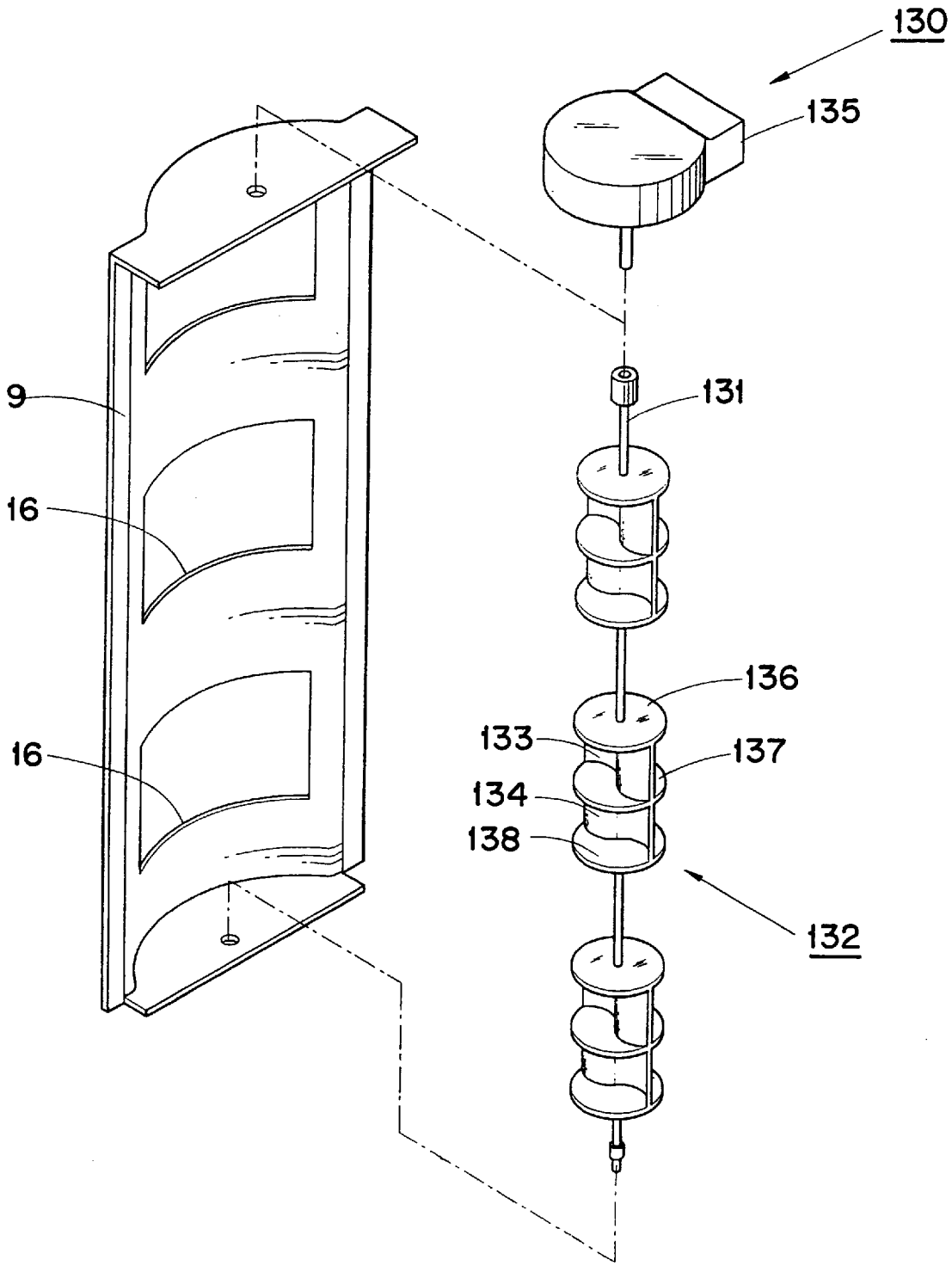
FIG. 3 (PRIOR ART)
FIG. 3 is an enlarged exploded perspective view of main elements of FIG. 2.

Hereinafter, the present invention will be described in detail with reference to the accompanying drawings. The same or similar parts with the parts shown in FIGS. 1 through 3 relating to the conventional art will be referred to with the same reference numerals. The description of the parts in each embodiment which are substantially the same with the parts of the prior art will be omitted.

Figure 4:
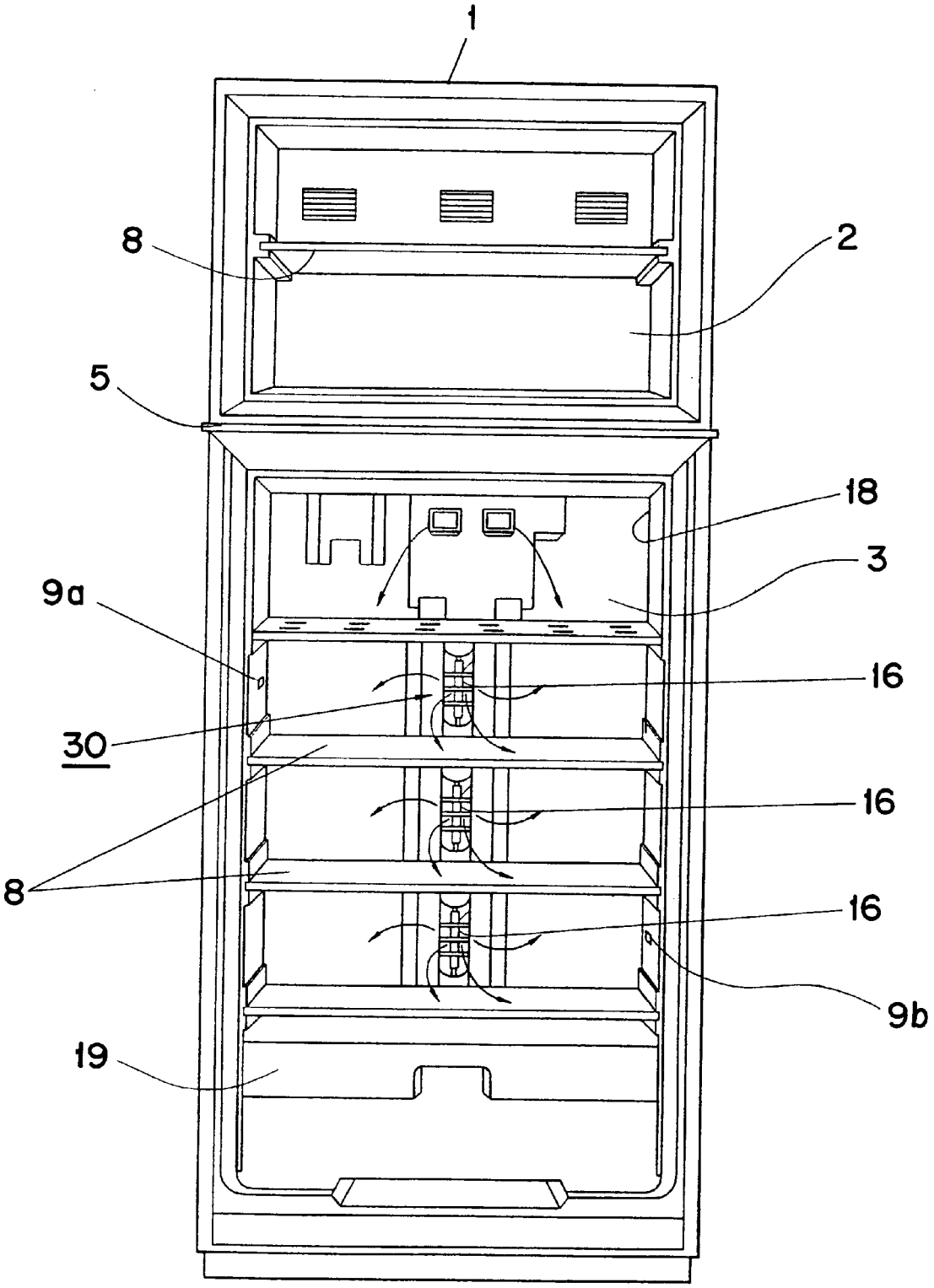
FIG. 4 is a front view of a refrigerator according to the present invention.
Figure 5:
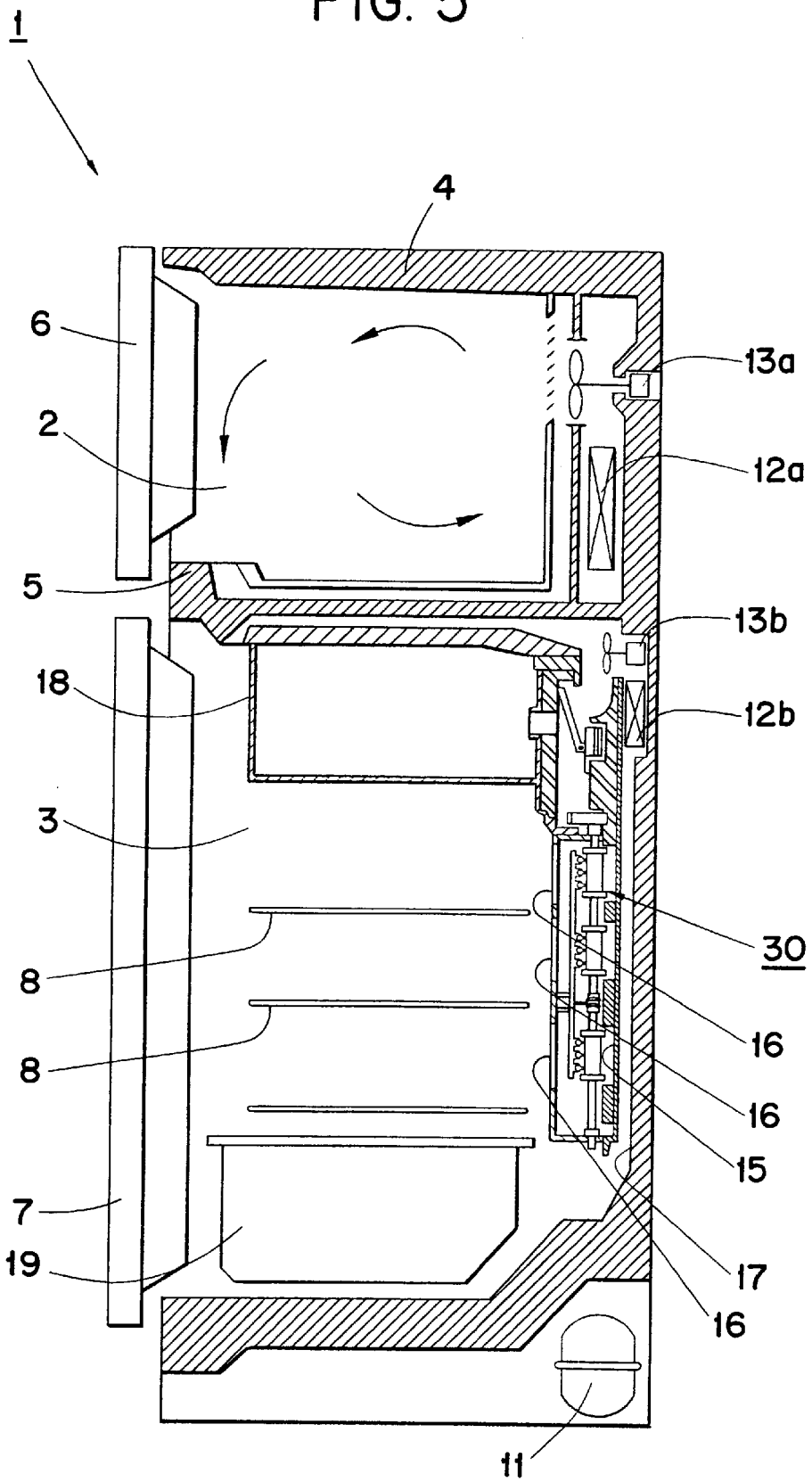
FIG. 5 is a side sectional view of FIG. 4.

FIGS. 4 and 5 show a refrigerator according to the present invention. The refrigerator has, as the conventional refrigerator which has been illustrated with reference to FIGS. 1 through 3, a cabinet 1 forming freezing compartment 2 and a fresh food compartment which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

At the rear side of the fresh food compartment 3, a supply duct 15 and a return duct 17 are provided. The cool air generated by the fresh food compartment evaporator 12*b* is blown by the fresh food compartment fan 13*b* so as to be supplied into the fresh food compartment 3 via the supply duct 15 and the cool air discharge ports 16. A device for dispersing the cool air horizontally is installed in the supply duct 15.

A pair of temperature sensors 9*a* and 9*b* are installed in the fresh food compartment 3. The temperature sensors 9*a* and 9*b* are comprised of a first temperature sensor 9*a* installed at the upper left portion of the fresh food compartment 3 and a second temperature sensor 9*b* installed at the lower right portion of the fresh food compartment 3.

Figure 6:
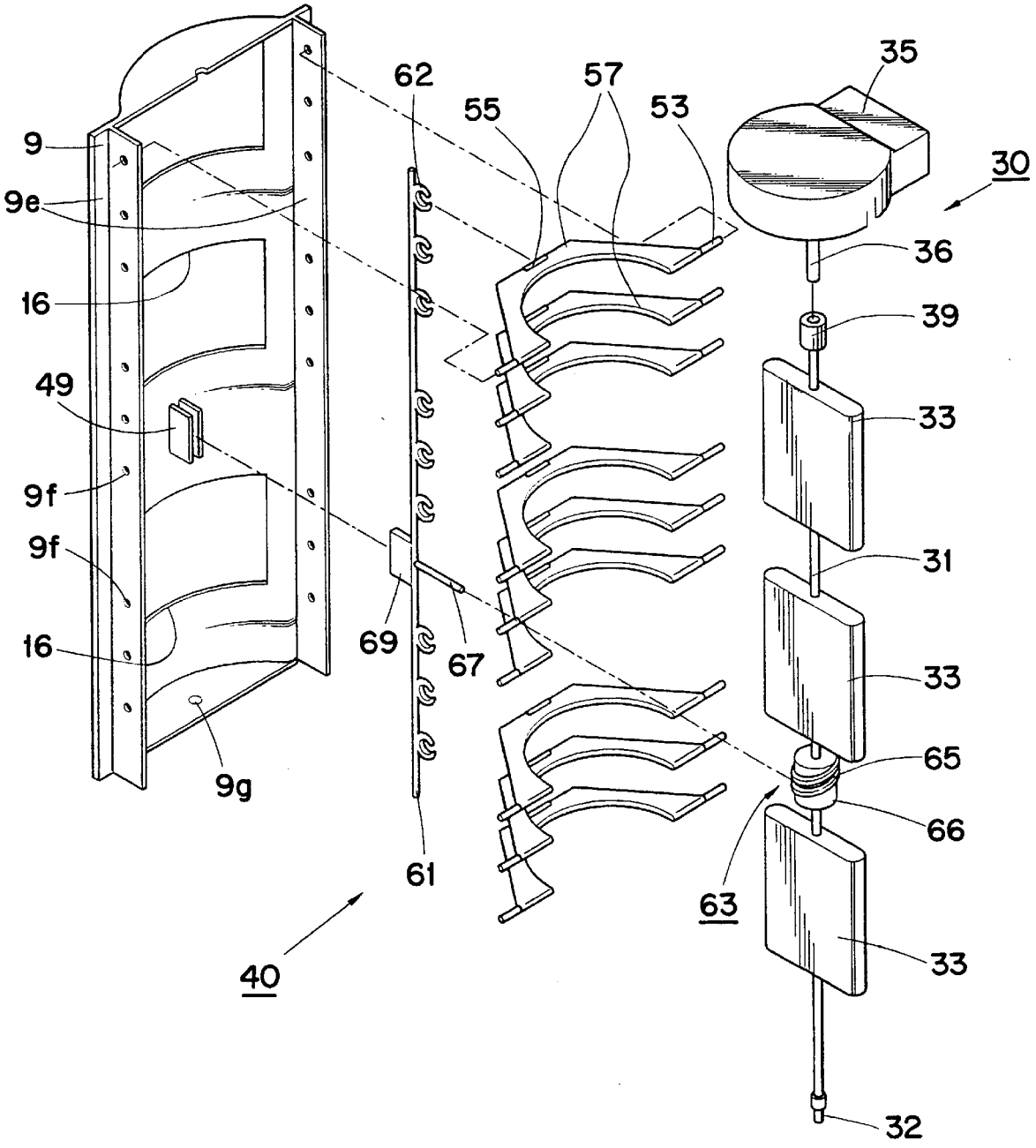
FIG. 6 is an enlarged exploded perspective view of a cool air dispersing device shown in FIG. 5.

FIG. 6 is an enlarged perspective view of the cool air dispersing device shown in FIG. 5. The refrigerator according to the present invention has a device 30 for dispersing cool air horizontally and a device 40 for dispersing the cool air vertically.

The horizontal-dispersing device 30 has a rotational shaft 31 having a vertical axis, three horizontal-dispersing blades 33 having the shape of a planar plate, and a driving motor 35 for rotating the rotational shaft 31. Three horizontal-dispersing blades 33 are disposed near the respective cool air discharge ports 16 formed on the duct plate 9 along an axis direction. A coupling part 39 being coupled with a driving shaft 36 of the driving motor 35 is provided at the upper end of the rotational shaft 31, and a journal part 32 supported rotatably by being inserted into a bearing hole 9*g* formed at the lower area of the duct plate 9 is provided at the lower end of the rotational shaft 31. It is preferable that the driving motor 35 is a stepping motor which is capable of controlling annular stop position.

Then, when the driving motor 35 operates, the horizontal-dispersing blades 33 are rotated by the rotational shaft 31, and thereby the cool air discharged through the cool air discharge ports 16 is dispersed horizontally.

The vertical-dispersing device 40 comprises a plurality of vertical-dispersing blades 57 which are disposed near the cool air discharge ports 16 and capable of pivoting about a horizontal axis, a link member 61 installed in the supply duct 15 to be capable of moving up and down, and an elevation/de-elevation cam 63 for elevating/de-elevating the link member 61.

The vertical-dispersing blade 57 is formed into an arc plate so as to accommodate the horizontal-dispersing blades 33, and a horizontal rotational shaft 53 is extended along a horizontal axis thereof at the left and right ends thereof. In correspondence with it, the duct plate 9 is formed with flange parts 9*e* which are extended backward from the rear surface of both side edges thereof and are facing to each other, and the flange parts 9*e* are formed with a plurality of shaft holes 9*f* for receiving and rotatably supporting the horizontal rotational shaft 53. The vertical-dispersing blades 57 are capable of pivoting in the cool air discharge ports 16 while the horizontal rotational shaft 53 thereof is inserted into the shaft holes 9*f*.

The link member 61 is disposed in parallel with the rotational shaft 31. The link member 61 is formed into the shape of a rod, and has a plurality of hinge assembly parts 62 which have the shape of a partial ring and protrude toward the vertical-dispersing blades 57. In correspondence to the hinge assembly parts 62, each of the vertical-dispersing blades 57 has a hinge part 55 at the inner central area thereof, which is formed into a cylinder disposed along the horizontal direction. The hinge assembly parts 62 are engaged with the hinge parts 73 to be capable of rotating relatively thereto.

The elevation/de-elevation cam 63 is installed on the rotational shaft 31 of the horizontal-dispersing device 30. The elevation/de-elevation cam 63 is comprised of a cylindrical cam body 66, and a cam groove 65 formed on the outer surface of the cam body 66. The cam groove 65 is a closed loop having an elevational/de-elevational cam profile along the cylindrical surface. On the link member 61 is provided an operation part 67 protruding transversely to the longitudinal direction thereof, and the free end of the operation part 67 is inserted into the cam groove 65 of the elevation/de-elevation cam 63.

Furthermore, the link member 61 has a guiding piece 69 protruding toward the duct plate 9, and the guiding piece 69 is accommodated in the elevation/de-elevation guiding part 49 formed on the inner wall of the duct plate 9. The elevation/de-elevation guiding part 49 accommodates the guiding piece 69 to be capable of guiding it up and down and preventing the link member 61 from rotating about the axis thereof.

Figure 7:
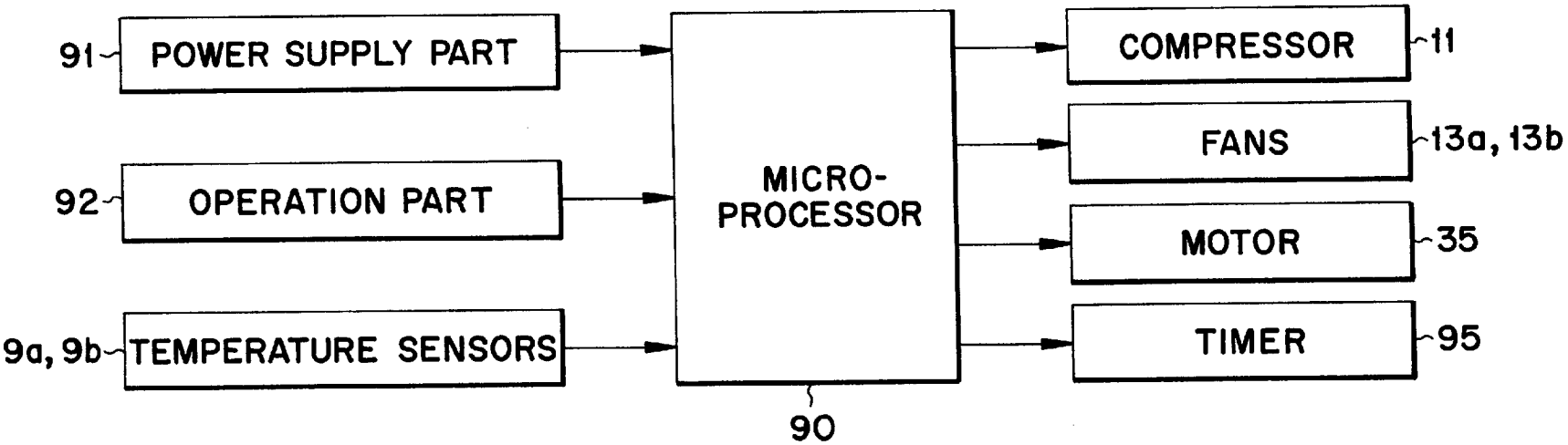
FIG. 7 is a block diagram for controlling the cool air dispersing device.

FIG. 7 is a block diagram for controlling the cool air dispersing device. The cool air dispersing device is controlled by a microprocessor 90. The microprocessor 90 receives signals from the first and second temperature sensors 9*a* and 9*b*, and thereby it senses the temperatures in the fresh food compartment 3. If the sensed temperatures are higher than a temperature that a user has set through an operation part 92, the microprocessor 90 operates the compressor 11 and the fans 13*a* and 13*b* to generate the cool air, and drives the driving motor 35 to control the cool air dispersing device. The reference numeral 91 is a power supply part for supplying electrical power to the microprocessor 90, and the reference numeral 95 is a timer providing the microprocessor 90 with data about the time needed in the microprocessor 90.

Figure 8:
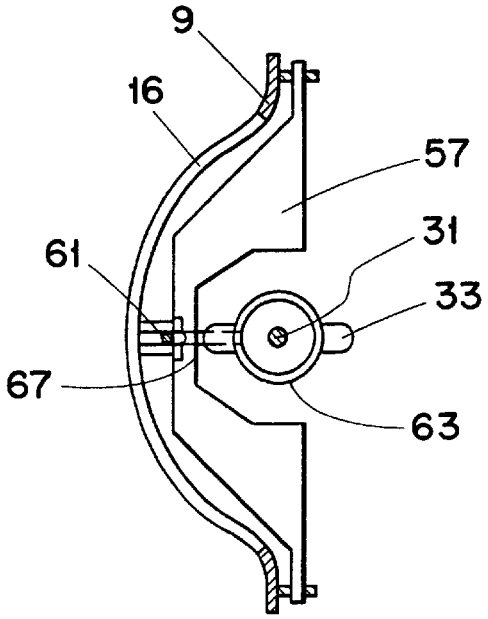
FIGS. 8 through 10 are enlarged transverse sectional views showing the cool air dispersing process performed by the horizontal-dispersing blades successively.
Figure 9:
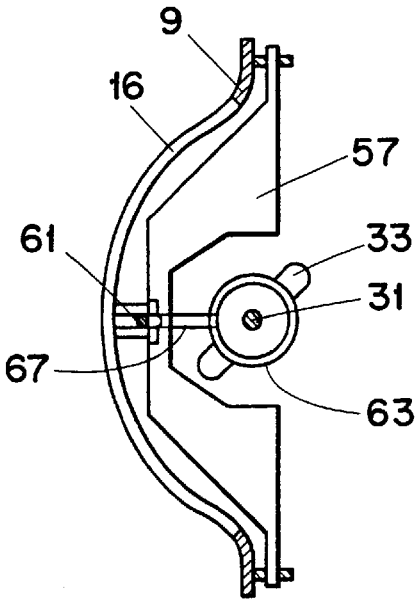
Figure 10:
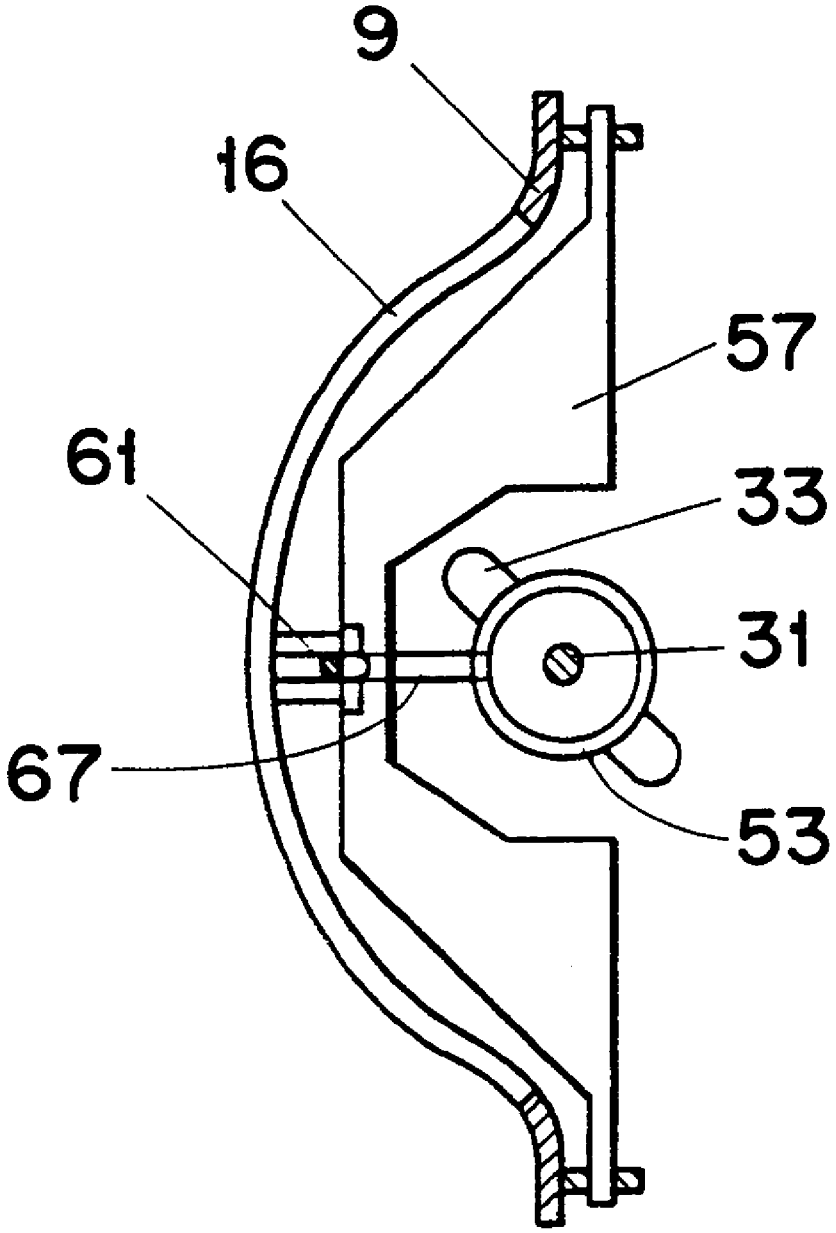

FIGS. 8 through 10 are transverse sectional views which show a discharge state of the cool air caused by the rotation of the horizontal-dispersing blades 33. As shown in FIG. 8, when the horizontal-dispersing blades 33 are directed to the front side, the cool air in the supply duct 15 is discharged to the front side along both sides of the horizontal-dispersing blades 33. When the horizontal-dispersing blades 33 are rotated to the left side or the right side as shown in FIGS. 9 and 10, the cool air is discharged toward the left side or the right side.

While the horizontal-dispersing device 30 operates to rotate the rotational shaft 31, the elevation/de-elevation cam 63 rotates together therewith, and the link member 61 is elevated/de-elevated by the operation part 67 engaged with the cam groove 65 of the elevation/de-elevation cam 63. The elevational/de-elevational movement of the link member 61 causes the pivoting of the vertical-dispersing blades 57 relatively to the horizontal rotational shaft 53 through the hinge assembly part 62 and the hinge part 55 of the vertical-dispersing blades 57.

Meanwhile, the elevation and de-elevation of the link member 61 is guided vertically by the guiding piece 69 and the elevation/de-elevation guiding part 49. Therefore, the link member 61 does not rotate but reciprocates in the vertical direction while the elevation/de-elevation cam 63 rotates.

Figure 11:
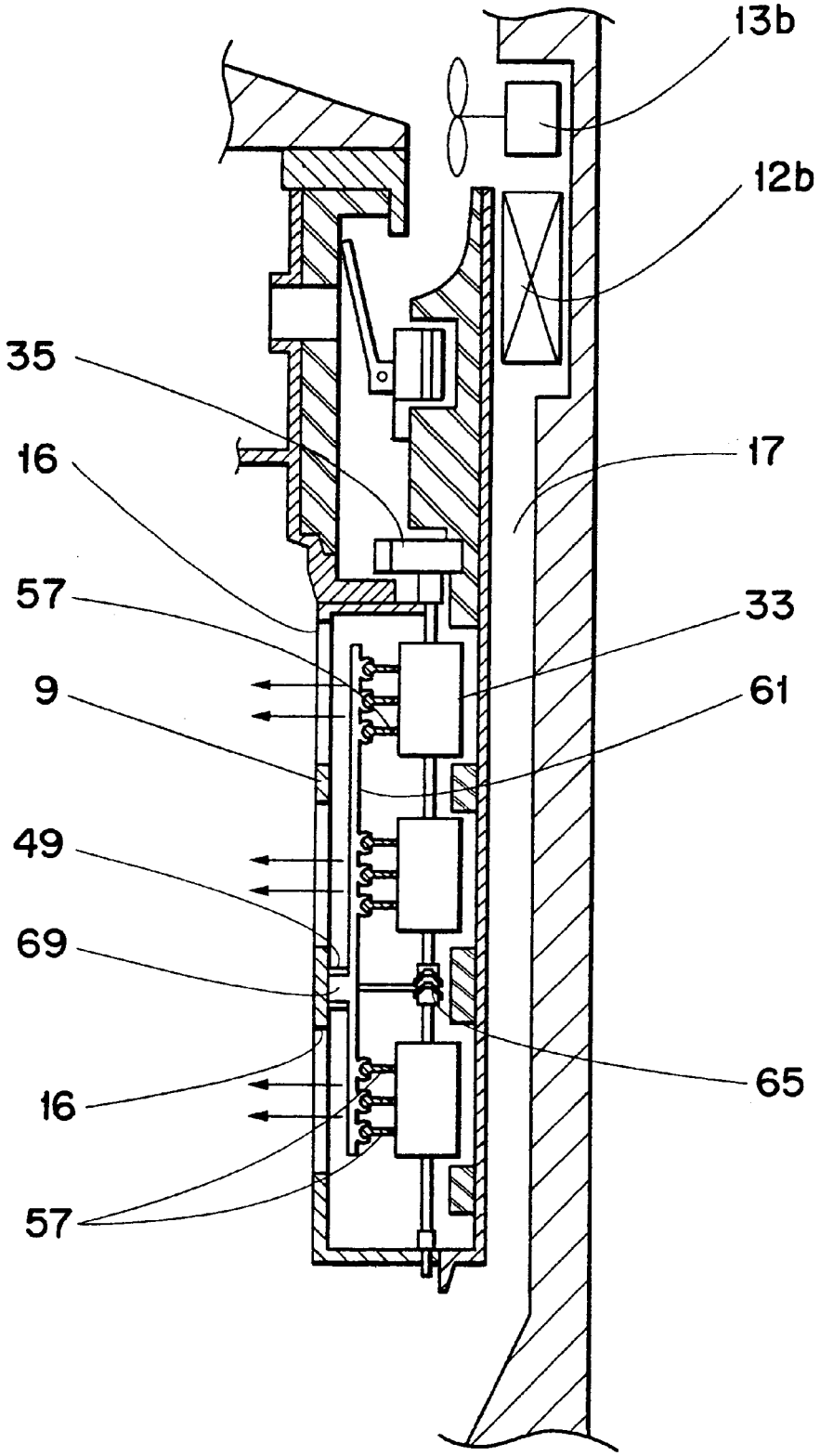
FIGS. 11 through 13 are enlarged side sectional views showing the cool air dispersing process performed by the vertical-dispersing blades successively.
Figure 12:
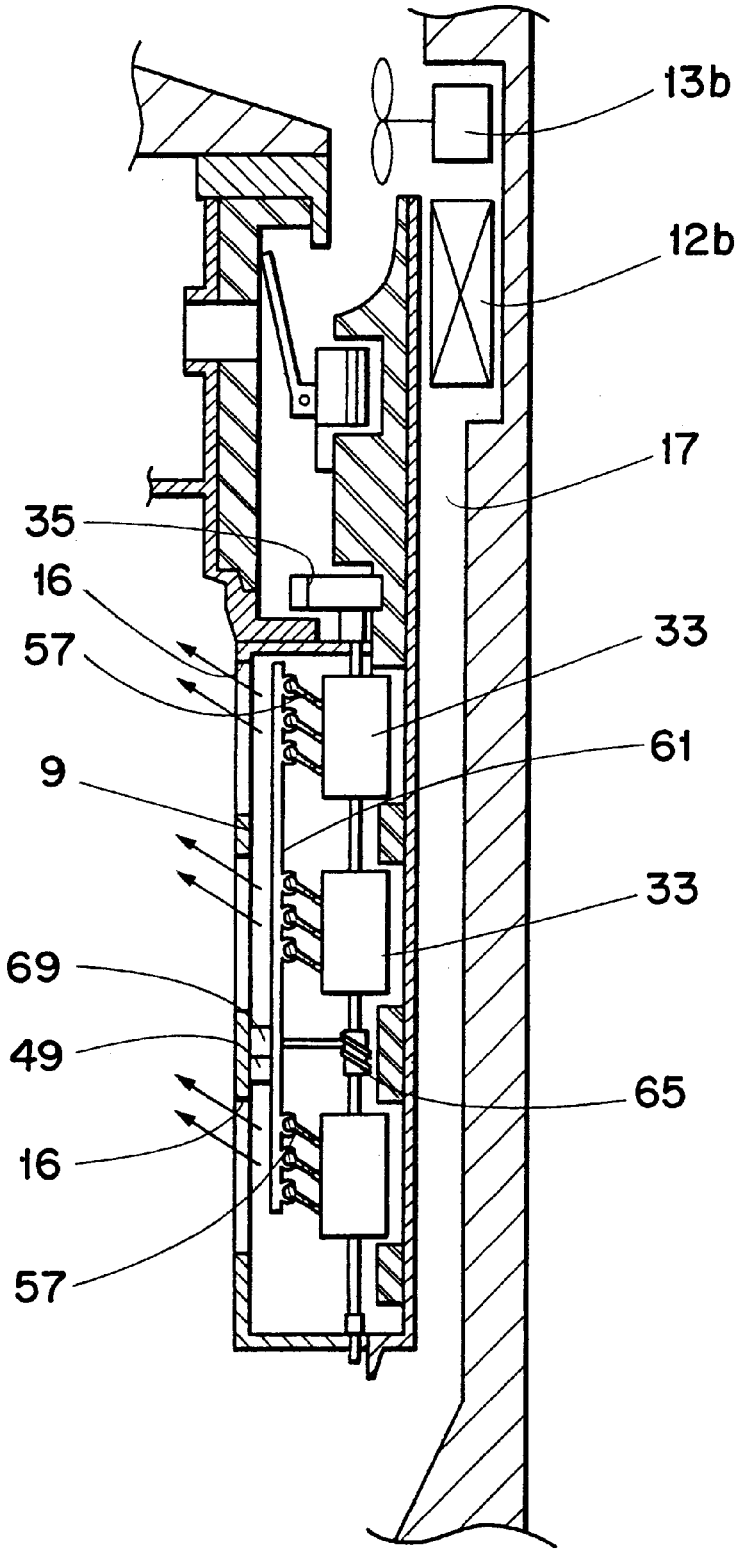
Figure 13:
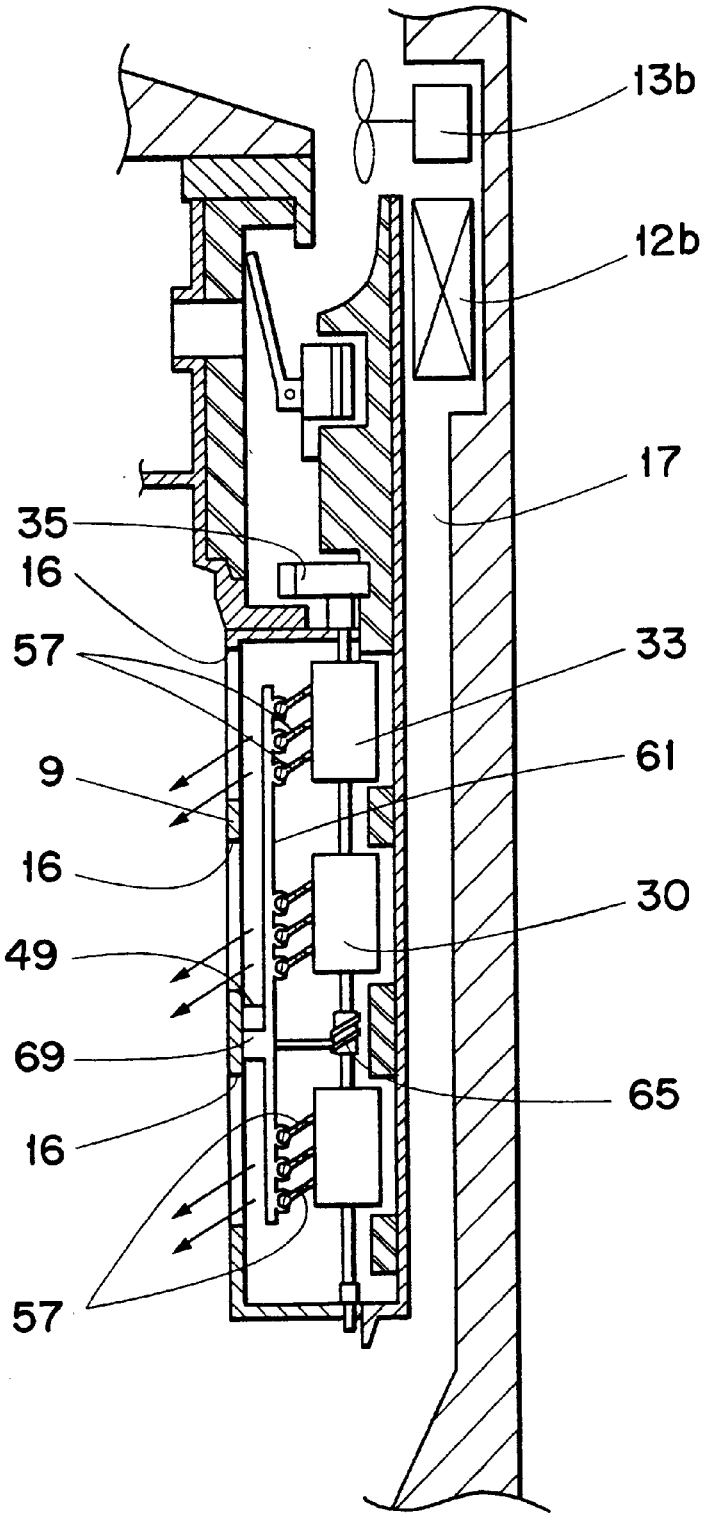

FIGS. 11 through 13 are side sectional views showing the elevational/de-elevational movement of the vertical-dispersing blades 57 caused by the rotation of the rotational shaft 31. As shown in FIG. 11, while the vertical-dispersing blades 71 are kept horizontal, the cool air is discharged horizontally. When the rotational shaft 31 rotates right, the vertical-dispersing blades 57 are tilted upward as shown in FIG. 12, and in such a situation, the cool air is discharged upward to be supplied into the upper area of the fresh food compartment 3. Also, as the rotational shaft 31 rotates left, the vertical-dispersing blades 57 are tilted downward as shown in FIG. 13. In such a situation, the cool air is discharged downward.

Figure 14:
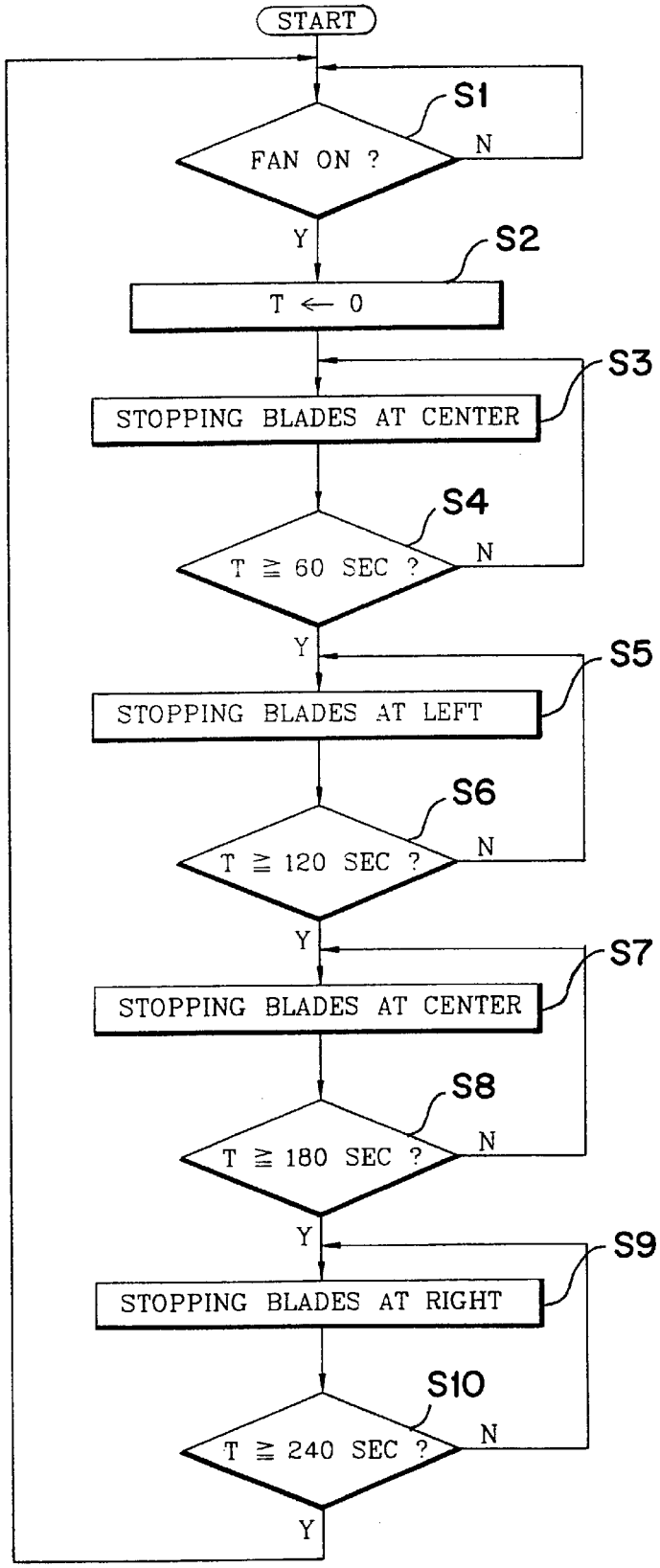
FIG. 14 is a flow chart showing the steps for controlling the refrigerator according to the present invention.

Hereinbelow, the operation of the refrigerator according to the present invention will be described with reference to FIG. 14.

The microprocessor 90 checks S1 whether the fans 13*a* and 13*b* are 'ON' or not. If the fans 13*a* and 13*b* are 'ON', the microprocessor 90 sets S2 the timer 95 to zero, and then stops S3 the horizontal-dispersing blades 33 as shown in FIG. 8 so that the cool air is discharged frontward. In such a situation, the vertical-dispersing blades 57 are in the horizontal state as shown in FIG. 11. Therefore, the cool air is discharged frontward horizontally.

The microprocessor 90 counts the time through the timer 95, and when the counted time reaches sixty seconds S4, drives the driving motor 35 to rotate S5 the horizontal-dispersing blades 33 left as shown in FIG. 9. In such a situation, the vertical-dispersing blades 57 are rotated downward as shown in FIG. 13. Therefore, the cool air is discharged left downwardly.

The microprocessor 90 counts the time through the timer 95 again, and when the counted time reaches one hundred and twenty seconds S6, drives the driving motor 35 to rotate S7 the horizontal-dispersing blades 33 right to stop it at center. Accordingly, the horizontal-dispersing blades 33 and the vertical-dispersing blades 57 are positioned as shown in FIGS. 8 and 11 respectively, and the cool air is discharged frontward horizontally again.

When the counted time reaches one hundred and eighty seconds S8, the microprocessor 90 drives the driving motor 35 again to rotate S9 the horizontal-dispersing blades 33 right as shown in FIG. 10. In such a situation, the vertical-dispersing blades 57 are rotated upward as shown in FIG. 12. Therefore, the cool air is discharged right upwardly.

As the time counted by the timer 95 reaches two hundred forty seconds S10, the microprocessor 90 returns to its initial state to check whether the fans 13*a* and 13*b* operate or not and reset the timer 95.

According to such a process, the cool air is supplied to the left lower part, central part, and right upper part during sixty seconds respectively. Therefore, the cool air is supplied more effectively to the respective parts of the fresh food compartment 3 in comparison with the conventional refrigerator which supplies the cool air through the cool air dispersing blades rotating continuously. Furthermore, since the horizontal-dispersing blades 33 and the vertical-dispersing blades 57 are formed into a planar plate shape, the vortex of the cool air does not occur during the cool air dispersing operation.

Meanwhile, in the present embodiment, horizontal-dispersing blades 33 are disposed in correspondence to the cool air discharge ports 16, however, it is possible that only one horizontal-dispersing blade is extended throughout all of the cool air discharge ports 16.

Furthermore, in the present embodiment, the vertical-dispersing blades 57 operate together with the horizontal-dispersing blades 33, however, it can be driven independently by a separate driving means. That is, if an additional driving motor controlled by the microprocessor 90 is provided, and the link member 61 is operated not by the elevation/de-elevation cam 63 but by the additional driving motor, it is possible to control the stop positions of the vertical-dispersing blades 57 in angular direction. Then, the vertical-dispersing blades 57 are controlled so that they are stopped at upper, central, and lower angular positions successively during predetermined times respectively, whereby the vertical-dispersing blades 57 can independently supply the cool air at vertical positions in the fresh food compartment 3.

In such a situation, it is preferable that the time interval for changing the angular position of the vertical-dispersing blades 57 is different from that of the horizontal-dispersing blades 33. For example, if the horizontal-dispersing blades 33 are driven with the time interval of sixty seconds as described above, the vertical-dispersing blades 57 are preferably driven with the time interval of forty seconds. Then, the cool air is supplied to more various areas of the fresh food compartment 3.

Furthermore, in the present embodiment, the time durations that the blades 33 and 57 are stopped at respective angular positions are the same with each other, however, it is possible to control them on the basis of the sensing result of the temperature sensors 9*a* and 9*b* so that a greater amount of cool air is discharged to an area of high temperature. In other words, if the temperature of the first area that the first temperature sensor 9*a* is installed is higher than that of the other areas, the driving motor 35 is controlled so that the time that the blades 33 and 57 are stopped toward the first area is longer to be about one hundred seconds than the time toward the other areas. Then, the uniform distribution of the temperature in the fresh food compartment 3 can be achieved more effectively.

In such a case, it is possible that the temperatures at a plurality of positions are sensed by a plurality of temperature sensors. If the horizontal-dispersing blades 33 and the vertical-dispersing blades 57 are driven independently of each other as illustrated above in the modification of the embodiment, it is easy to supply a greater amount of cool air to an area that the temperature thereof is highest among the plurality of areas.

As described above, according to the present invention, the cool air is supplied without a vortex, and is dispersed effectively since the angular position of the cool air dispersing blades is successively changed with predetermined time intervals. In particular, the cool air is more uniformly distributed since the time that the cool air dispersing blades are stopped toward the high temperature area is longer than the time toward the other areas.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cooling compartment for storing food, and a duct being provided in a side wall of said cooling compartment, said duct for forming a cool air passage, said duct having at least one cool air discharge port opened into said cooling compartment, said refrigerator comprising:

a horizontal-dispersing blade of planar plate shape being rotatably installed near the cool air discharge port in said duct, said horizontal-dispersing blade arranged for controlling a discharge direction of cool air discharged through the discharge port horizontally according to an annular position thereof;

a rotational shaft being connected with said horizontal-dispersing blade, said rotational shaft being extended along a vertical axis;

a motor for rotating said rotational shaft, said motor being capable of controlling an angular position thereof;

a control part for controlling said driving motor so that said horizontal-dispersing blade is stopped at a plurality of angular positions successively during predetermined times respectively;

a plurality of vertical-dispersing blades each having a horizontal rotational axis: a means for pivoting said vertical-dispersing blades vertically.

2. The refrigerator as claimed in claim 1, wherein said control part controls said driving motor so that respective predetermined times that said horizontal-dispersing blade is stopped at said plurality of angular positions are the same with each other.

3. The refrigerator as claimed in claim 1, further comprising a plurality of temperature sensors installed in said cooling compartment, said temperature sensors arranged for sensing temperatures of a plurality of areas in said cooling compartment respectively.

4. The refrigerator as claimed in claim 3, wherein said control part controls said driving motor so that a time that said horizontal-dispersing blade is stopped at an angular position corresponding to an area of high temperature among said plurality areas is longer than a time that said horizontal-dispersing blade is stopped at other angular positions.

5. The refrigerator as claimed in claim 1, wherein said pivoting means comprises:

a link member having a plurality of hinge assembly parts respectively assembled with said vertical-dispersing blades at positions distanced from said horizontal axis, said link member being capable of moving up and down in the vertical direction; and a means for elevating/de-elevating said link member.

6. The refrigerator as claimed in claim 5, wherein said elevating/de-elevating means comprises:

an elevation/de-elevation cam being installed on said rotational shaft of said horizontal-dispersing blade, said elevation/de-elevation cam rotating together with said rotational shaft; and an operation part formed in a body with said link member, said operation part interacting with said elevation/de-elevation cam so that a rotational movement of said elevation/de-elevation cam is transmitted to said link member as an elevational/de-elevational movement thereof.

7. The refrigerator as claimed in claim 6, further comprising a means for guiding said link member so as to be capable of moving up and down vertically while preventing rotation of said link member.

8. The refrigerator as claimed in claim 1, wherein said driving motor is a stepping motor.

* * * * *